US005237915A

United States Patent [19]

Rounsley

[11] Patent Number: 5,237,915

[45] Date of Patent: Aug. 24, 1993

[54] MIXED ROLL CALENDER

[75] Inventor: Robert R. Rounsley, Chillicothe, Ohio

[73] Assignee: The Mead Corporation, Dayton, Ohio

[21] Appl. No.: 993,468

[22] Filed: Dec. 15, 1992

Related U.S. Application Data

[63] Continuation of Ser. No. 830,620, Feb. 4, 1992, abandoned.

[51] Int. Cl.[5] ..... B30B 3/04; D21G 1/00

[52] U.S. Cl. ..... 100/162 R; 100/161

[58] Field of Search ..... 100/161, 162 R, 162 B, 100/163 R, 163 A

[56] References Cited

U.S. PATENT DOCUMENTS

| | | | |
|---|---|---|---|
| 3,091,173 | 5/1963 | Koch | 100/162 R |
| 3,291,039 | 12/1966 | Christie | 100/162 R |
| 3,336,862 | 8/1967 | Brundige et al. | 100/162 R |
| 3,451,331 | 6/1969 | Fredrickson et al. | 100/162 R |
| 4,332,191 | 6/1982 | Kankaanpaa | 100/162 R |
| 4,366,752 | 1/1983 | Koski . | |
| 4,534,829 | 8/1985 | Ahrweiler et al. . | |
| 4,606,264 | 8/1986 | Agronin et al. | 100/162 B X |
| 4,624,744 | 11/1986 | Vreeland . | |
| 4,915,026 | 4/1990 | Halme . | |
| 4,960,046 | 10/1990 | Anstötz et al. . | |
| 5,024,150 | 6/1991 | Brendel et al. | 100/163 R X |

FOREIGN PATENT DOCUMENTS

| | | | |
|---|---|---|---|
| 2241968 | 9/1991 | United Kingdom | 100/162 R |

OTHER PUBLICATIONS

"The Effect of Supercalender Roll Fillings on Paper Printability", Ronald D. Agronin, *Tappi*, vol. 61, No. 9 (1978).

"The Finishing Action of a Supercalender Nip", J. David Pfeiffer, *Symposium on Calendering and Supercalendering of Paper*, U. of Manchester, England (1975).

"Soft Calendering Technique of Today", Doetsch and Peel, Presentation at the Finnish Paper Engs. Assoc. Helsinki (1987).

"How Paper Properties Can Be Developed Using Different Methods of Calendering", Robert R. Rounsley, *TAPPI*, vol. 74, No. 1 (1991).

"Supercalender Variables Affecting Paper Quality", Michael Agronin, *TAPPI*, vol. 66, No. 10 (1983).

"Hard-Nip and Soft-Nip Calendering of Uncoated Groundwood Papers", R. H. Crotogino and M. F. Gratton, *Pulp and Paper Institute of Canada* (1987).

"Analyzing Effects of Hot Calendering on the Printability of Coated Papers", E. E. Munch et al., *Paper Trade Journal*, pp. 29-33 (1979).

"Supercalendering-1980 Update", *Presentation at the Finishing Conference in Portland, Me.* (1980).

On-Machine Soft Calendering: A Good Idea Whose Time Has Come?, Les Y. Ishinose, Dec., 1984.

*Primary Examiner*—Stephen F. Gerrity

*Attorney, Agent, or Firm*—Thompson, Hine and Flory

[57] ABSTRACT

A calender stack having a plurality of hard and soft calender rolls for use in calendering a coated or uncoated paper web which comprises employing a plurality of soft rolls exhibiting at least two distinct levels of hardness and arranging the rolls in a calender such that the level of hardness is progressively harder in the direction of travel of the coated paper web.

18 Claims, 1 Drawing Sheet

MIXED ROLL CALENDER

This is a continuation of co-pending application Ser. No. 07/830,620, filed Feb. 4, 1992 (now abandoned).

BACKGROUND OF THE INVENTION

This invention relates to a mixed roll calender arrangement having a combination of hard and soft rolls which improves both the smoothness and gloss uniformity of a paper web and particularly a coated paper web.

The calendering of a paper web leaving the discharge end of a paper machine is a well known final finishing treatment for determining the smoothness and gloss of the surfaces of the paper as well as its consistency. Such calendering is generally accomplished by guiding a continuous paper web successively through a series of nips formed by calendering rolls.

Conventionally, a paper web is calendered in a stack of rolls which may be a machine finishing stack in which the rolls are all iron or steel rolls and the nips defined by such rolls are called hard nips. Such machine calendering treatment may be complemented, if necessary, by a supercalendering or soft calendering treatment in a separate supercalender. In the supercalender arrangement, the rolls are commonly covered with a resilient material, and these covered rolls are used in combination with iron or steel rolls to form soft nips.

It is generally accepted that the influence of calendering on a web to be processed is the production of higher gloss on the surface facing the hard roll in the nip. There are, however, several factors which affect the gloss and smoothness of the web such as nip load, speed, temperature, sheet moisture, and the material used to form the elastic covering.

SUMMARY OF THE INVENTION

It is an object of the present invention to provide an improved calender arrangement to produce a paper web, particularly a coated paper web having a smoother surface and a more uniform gloss.

This and other objects are attained in accordance with the present invention which comprises employing a plurality of soft and hard rolls in which there are at least two different and distinct levels of hardness exhibited by the plurality of soft and hard rolls wherein the nips become progressively harder in the forward direction of travel of the paper web as the web travels through the calender.

BRIEF DESCRIPTION OF THE DRAWINGS

A more complete appreciation of the present invention and the advantages thereof will be readily understood by reference to the following drawings wherein.

DETAILED DESCRIPTION OF THE INVENTION

Figure 1:
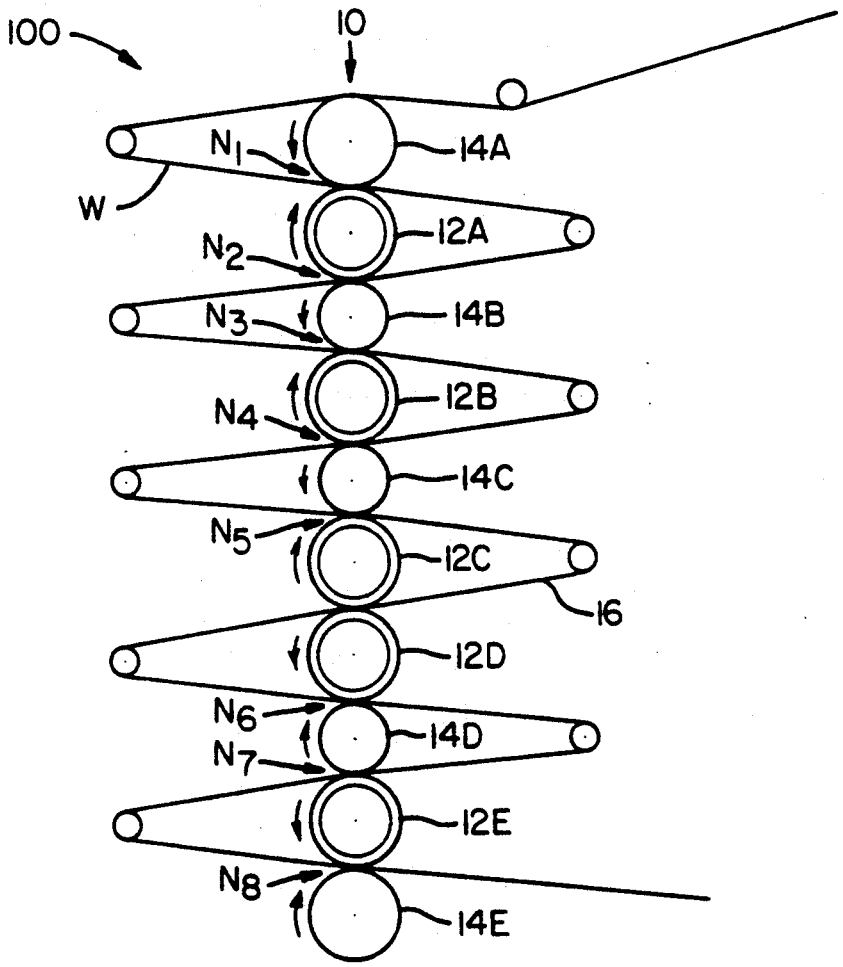
FIG. 1 is a schematic lateral view of a 10-roll supercalender arrangement according to the present invention showing only the contour of the rolls.

The calender 100 of the present invention as shown in FIG. 1 comprises a vertical stack of rolls 10 which includes a plurality of soft rolls 12A, 12B, 12C, 12D and 12E, and a plurality of steel rolls 14A, 14B, 14C, 14D and 14E. Each of the soft rolls is independently loaded, whereas, in a supercalender the difference in loading going from top to bottom of the calender stack is limited by the dead weight of the rolls.

The soft calender roll allows the calender load to be distributed more uniformly across the web. While a hard roll must deform the flocks before it can act on the surrounding paper, the soft roll itself deforms leading to more intimate contact with the web.

In practice, the harder roll will produce the higher gloss, but it also generates mottle which is the irregular appearance of the glossy surface. The machine calender, which employs all hard rolls, is used primarily to control the caliper of the final sheet.

The soft roll produces a much wider nip than the harder roll which results in a lower actual nip pressure for the soft roll. The softer roll gives the web more time in the nip, thereby producing smoother sheets with improved gloss and surface uniformity.

Another factor affecting the gloss and surface smoothness of the web is the moisture content of the web material. The moisture in the web is very important in that it softens the cellulose fibers beneath the coating. Typically, the moisture level for coated paper will range from about 1 to 7% and up to about 12% or more for uncoated paper. The web can be moisturized by means of a steam shower or water mist spray. The advantage of the steam is that it will provide both moisture and temperature gradients in the web. A disadvantage of steam is that it easily leads to picking or dusting.

Elevated temperatures also soften the cellulose fibers. Typical operating temperatures are in the range of about 60° to 200° C. and preferably about 60° to 90° C.

In FIG. 1, the vertical stack of rolls 10 is arranged, so that soft rolls 12A–12E are associated with steel rolls 14A–14E to form nips $N_1$–$N_8$ through which the web W passes.

In following the travel of a coated web W as it traverses the vertical stack 10 of calender rolls, the coated surface 16 faces steel rolls 14A–14C as it passes through successive nips $N_1$–$N_5$. Soft rolls 12C and 12D are arranged adjacent to each other to form a reversing pair of soft rolls which allows the coated surface 16 of the coated web W, at that point, to face soft rolls 12D and 12E as the web W continues to traverse the stack of 10 through nips $N_6$–$N_8$. For convenience, rolls 12A–12E are illustrated as the soft rolls and rolls 14A–14E are illustrated as the steel rolls. In reality, the configuration of the rolls is insignificant since the present invention is controlling the degree of hardness of the respective rolls in the direction of travel of the coated paper web, and particularly in a manner such that the degree of hardness of the rolls progressively increases as the coated paper web passes through the calender. The range of hardness employed in accordance with the present invention can be from about 60° up to about 100° Shore D and, preferably, from about 80° to 93° Shore D.

In accordance with the present invention, each of the soft rolls 12A–12E may be progressively harder than the preceding soft roll, or the level of specific hardness of soft rolls may be defined by a series of soft rolls in which two or more consecutive soft rolls have the same degree of hardness and the progressive hardness is provided by the successive series of soft rolls.

While the progression of hardness throughout the calender is generally from softer to harder rolls, there is evidence that the last soft roll, and perhaps others as well, can be measurably softer than the preceding roll to provide other superior properties. The full benefit of such an arrangement has not yet been determined.

Queen and King crown Rolls, 14A and 14E respectively, and hard rolls 14B–14D are formed of chill casting or steel, the surfaces of which have been ground smooth.

The soft rolls 12A–12E, as defined earlier, may be filled rolls wherein the fill material is an elastic material such as paper, cotton, linen, wool, denim, etc., or an elastomer cover such as hard rubber, plastic or similar material. Examples of commercially available soft rolls include:

| Supplier | Country | Name | Hardness |
|---|---|---|---|
| Beloit | USA | Supertex | 89–93 |
| Kleinewefers | Germany | Elabond | 89 |
| | Germany | Elaplast | 93 |
| Kusters | Germany | Matte-on-line | 89 |
| Rollin | France | Matte-on-line | 89 |
| Stowe-Woodward | USA | Plastec | 86 |
| | USA | Glossmate | 60–70 |
| | USA | Dynarock | 90 |
| Valmet | Finland | VRC-3 | 89 |
| Yamauchi | Japan | Mirrormax 5500 | 89 |
| | Japan | Mirrormax 5600 | 93 |

In accordance with the present invention, rolls 12A–12E exhibit different levels of hardness and are arranged in a calender such that the hardness of the individual rolls or the specific series of rolls increases along the path of travel of the web W.

As an example of the improved calender arrangement of the present invention, FIG. 1 can be envisioned as a 10-roll calender stack where crown rolls 14A and 14E consist of standard chill casting or steel rolls and soft rolls 12A–12E are covered or filled rolls wherein rolls 12A and 12B have a hardness of 86° Shore D, rolls 12C and 12D have a hardness of 89° Shore D, and roll 12E has a hardness of 92° Shore D. Such a configuration can easily be extended to a 12-roll calender by the addition of another soft roll of 92° Shore D hardness in combination with an additional steel roll between steel roll 14E and soft roll 12E.

Figure 2:
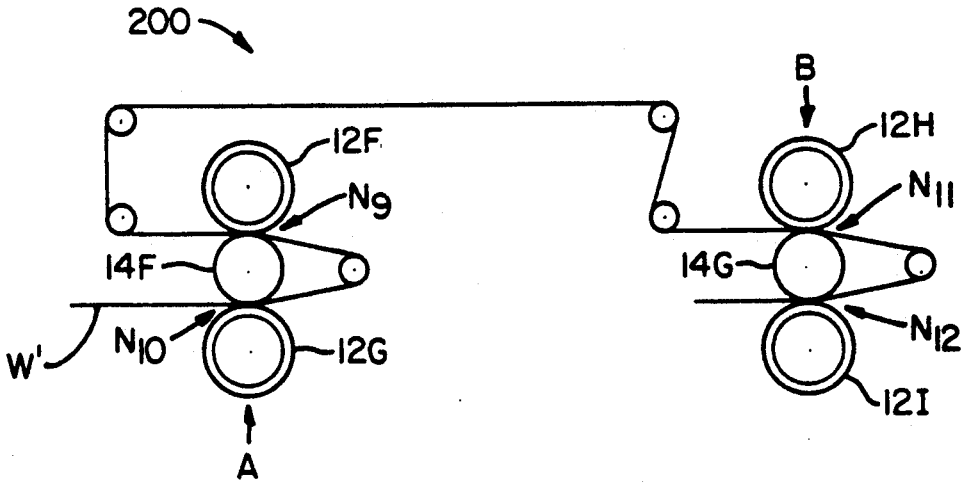
FIG. 2 is a schematic lateral view of a compact 6-roll calender arrangement according to the present invention showing only the contour of the rolls.

A compact calender arrangement 200 in its most simple form can be exemplified by envisioning FIG. 2 as two vertical short sets of calender rolls wherein a first set of calender rolls A include a first set of nips $N_9$ and $N_{10}$ defined by soft rolls 12F and 12G which have a hardness of 86° Shore D in combination with steel roll 14F, and a second set of calender rolls B includes a second set of nips $N_{11}$ and $N_{12}$ defined by soft rolls 12H and 12I which have a hardness of 92° Shore D in combination with steel roll 14G. The first set of calender rolls, A, and the second set of calender rolls, B, are arranged along the path of the coated paper web W' such that set B is in a forward location relative to set A.

Obviously, numerous modifications and variations of the present invention are possible in light of the above teachings. It is, therefore, to be understood that such modifications and variations are within the spirit of the present invention as disclosed and within the scope of the appended claims.

Having described the invention in detail and by reference to preferred embodiments thereof, it will be apparent that modifications and variations are possible without departing from the scope of the invention defined in the appended claims.

What is claimed is:

1. A calender stack for calendering a coated or uncoated paper web which comprises a plurality of hard and soft calender rolls forming a plurality of soft calender nips, the hardness of said soft rolls being progressively harder in the direction of travel of said web.

2. The calender stack of claim 1 wherein said plurality of soft rolls have elastic coverings, said plurality of soft rolls exhibiting at least two distinct levels of hardness within the range of about 60° to 100° Shore D.

3. The calender stack of claim 2 wherein the levels of hardness are within the range of about 80° to 93° Shore D.

4. The calender stack of claim 2 wherein said elastic coverings are rubber.

5. The calender stack of claim 2 wherein said elastic coverings are plastic.

6. The calender stack of claim 2 wherein said elastic coverings are selected from the group consisting of paper, cotton, linen, wool and denim.

7. The calender stack of claim 1 wherein said calender is a 10-roll calender.

8. The calender stack of claim 7 wherein said plurality of soft rolls exhibits three levels of hardness, the first level of hardness being about 80° Shore D, the second level of hardness being about 89° Shore D, and the third level of hardness being about 92° Shore D.

9. The calender stack of claim 1 wherein said calender is a compact calender comprising at least two sets of calender rolls.

10. The calender stack of claim 9 wherein said plurality of soft rolls exhibits two levels of hardness, the first level of hardness being about 86° Shore D and the second level of hardness being about 92° Shore D.

11. The calender stack of claim 1 wherein said hard rolls are steel rolls.

12. The calender stack of claim 1 wherein said hard rolls are chill cast rolls.

13. The calender stack of claim 1 wherein said paper web is a coated paper having a moisture content of about 1 to 7%.

14. The calender stack of claim 1 wherein said paper web is an uncoated paper having a moisture content of about 1 to 12%.

15. The calender stack of claim 1 wherein said calender is a 12-roll calender.

16. A calender stack for calendering a coated or uncoated paper web which comprises a plurality of hard and soft calender rolls forming a plurality of soft nips, the hardness of said soft calender rolls being progressively harder in the direction of travel of said web, said soft calender rolls reaching a controlled maximum level of hardness whereafter said level of hardness of said soft calender rolls is progressively softer in the direction of travel of said web.

17. The calender stack of claim 16 wherein each of said soft calender rolls are progressively harder in the direction of travel of the web with the exception of the last soft calender roll, said last soft calender roll being softer than the preceding soft calender roll.

18. In a calender stack for paper finishing wherein said calender stack consisting of hard and soft rolls for use in calendering a coated or uncoated paper web, the improvement which comprises: employing a plurality of soft rolls, said plurality of soft rolls exhibiting at least two distinct levels of hardness in said calender such that the level of hardness of said soft rolls is progressively harder in the direction of travel of the paper web.

* * * * *